United States Patent [19]

Vayssiere et al.

[11] 4,382,817

[45] May 10, 1983

[54] PROCESS FOR PERIODICALLY AND PNEUMATICALLY STIRRING A BATH OF MOLTEN METAL

[75] Inventors: Pierre Vayssiere, Metz; Jean-Claude Grosjean, Semecourt, both of France

[73] Assignee: Institute de Recherches de la Siderurgie Francaise, Saint-Germain-en-Laye, France

[21] Appl. No.: 222,513

[22] Filed: Jan. 2, 1981

[30] Foreign Application Priority Data

Jan. 2, 1980 [FR] France ..... 80 00083

[51] Int. Cl.[3] ..... C21C 5/34

[52] U.S. Cl. ..... 75/59; 75/60

[58] Field of Search ..... 75/59, 60

[56] References Cited

U.S. PATENT DOCUMENTS 3,706,549 12/1972 Knuppel ..... 75/60
3,817,744 6/1974 Leroy ..... 75/60
3,819,165 6/1974 Courard ..... 75/60
3,953,199 4/1976 Michaelis ..... 75/60
4,001,009 1/1977 Bauer ..... 75/60
4,174,212 11/1979 Bauer ..... 75/60

*Primary Examiner*—P. D. Rosenberg
*Attorney, Agent, or Firm*—Michael J. Striker

[57] ABSTRACT

A process for periodically and pneumatically stirring a bath of molten metal, wherein during the periods in which no stirring effect is required a fluid in gaseous state is injected through injection devices below the surface of the bath of molten metal in an amount sufficient to prevent blockage of the devices, whereas during the periods in which a stirring effect is required a fluid in liquid state which will vaporize quickly upon contact with the liquid metal is injected to provide an optimum amount of mixing gas with a minimum of injection devices.

The process is advantageously used in converters for pneumatically converting pig iron into steel and in which oxygen is blown from above onto the bath of molten metal.

13 Claims, 2 Drawing Figures

PROCESS FOR PERIODICALLY AND PNEUMATICALLY STIRRING A BATH OF MOLTEN METAL

BACKGROUND OF THE INVENTION

The present invention relates to pneumatic stirring operations of a bath of molten metal by injecting a gas under the surface of the bath.

As is known, such operations are applicable to various industrial sectors and especially in siderurgy, in which it has already been proposed (French Pat. No. 2,322,202) to combine a pneumatic conversion process of cast iron into steel in a converter by blowing oxygen from above by means of a lance onto the bath of molten metal, with the blowing of an inert gas into the bath during and after the refining by oxygen through injection means communicating with the bath under the surface thereof and located in the wall of the converter, or usually in the bottom of the latter.

A handicap of this technique is that quite often the pneumatic stirring is only temporarily used or required for the treatment of the metal, while the injection of the gas, which produces the stirring is permanently required to prevent the molten metal from plugging up the means for the injection of the gas by solidifying at these means.

In this respect, if, taking under consideration the available pressure of the installation, the injection means is calibrated in such a manner as to obtain an optimal gas discharge during the stirring period, the minimum discharge necessary outside the stirring periods to protect the injection means against the risk of blocking, constitutes a substantial penalty to the economy of the arrangement, which cannot be justified for metallurgical reasons.

Conversely, if the injection means are calibrated in such a manner as to minimize the discharge of gas during the periods in which no stirring effect is required, it is often difficult, in fact impossible, to obtain the necessary gas throughput for an efficient stirring. While it may be possible to multiply the number of the injection means, in doing so, one would be back to the preceding problem.

SUMMARY OF THE INVENTION

It is an object of the present invention to overcome the above-mentioned difficulties.

It is a further object of the present invention to provide a process for periodically and pneumatically stirring a bath of molten metal by introducing an inert fluid through injection means below the surface of the bath in which the means for injecting the gas are properly protected during the period in which no stirring of the molten metal is required, and in which a proper stirring of the molten metal is carried out during the remainder of the process.

With these and other objects in view, which will become apparent as the description proceeds, the process for periodically and pneumatically stirring a bath of molten metal by introducing an inert fluid through injection means below the surface of the bath mainly comprises the step of feeding, during the period in which no stirring effect is required, a fluid in gaseous state through the injection means into the bath and feeding, during the period in which a stirring effect is required, a fluid in liquid state which will vaporize quickly upon contact with the molten metal through the injection means into the bath.

The fluid injected in gaseous state and the fluid injected in liquid state may be of the same chemical composition, or on the other hand, these fluids may be of different chemical compositions.

According to another feature of the present invention, the fluid injected in liquid form presents a high ratio of volumetric mass to molecular mass.

The process according to the present invention may be carried out with an injection arrangement constituted by tuyeres communicating with the bath of liquid metal below the surface thereof or by an injection arrangement constituted by a plurality of pieces of refractory material incorporated in the bottom of a vessel containing the bath of molten metal and having an oriented selective permeability. Such pieces of refractory material are described in the French application Ser. No. 79/10.445 filed by IRSID on Apr. 25, 1979.

The invention, as understood, consists therefore in its essential characteristics, in modifying during the operation the physical state of the stirring fluid, and eventually also the chemical composition thereof, in such a manner to inject a protective gas through the injection device when stirring of the bath of molten metal is not necessary, and to inject a stirring liquid instead during the periods in which stirring of the molten metal is to take place.

Thus, the invention constitutes an elegant solution for the problem pointed out above, by permitting to reconcile the apparent contradictory requirements to minimize the protection output and to optimize the stirring output by means of the same injection device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
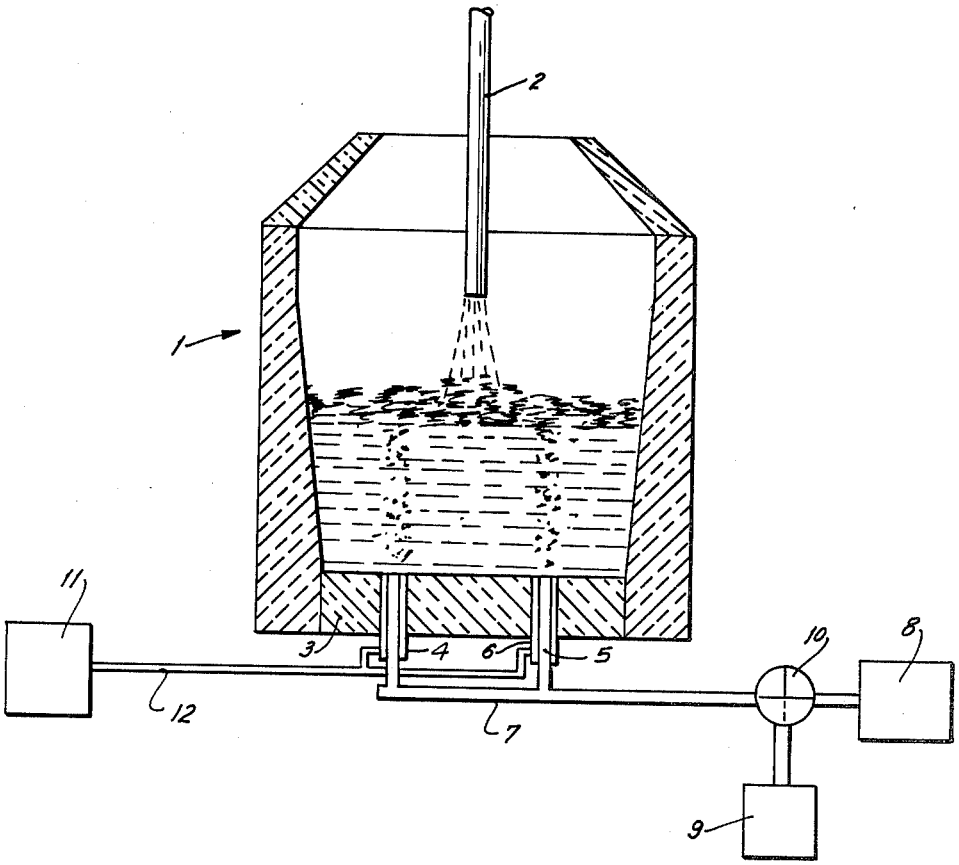
FIG. 1 illustrates a first embodiment according to the present invention, in which the injection device comprises a plurality of tuyeres.

Referring now to FIG. 1, there is illustrated a converter 1 of the type LD and of a capacity of about 60 t and containing a bath of molten metal, for instance cast iron, into which oxygen is blown from above by a lance 2. A plurality of tuyeres 4 of steel extend through the bottom 3 of the converter to communicate with the interior of the latter. For instance, four tuyeres uniformly displaced from each other may be provided in the bottom 3 of the converter 1. Each of the tuyeres 4 comprises a central tube 5 of an inner diameter of, for instance, 5 mm, and an outer tube 6 concentric with the tube 5 and defining with the latter an annular space into which a cooling fluid is inserted. The tubes 5 are connected at the outer ends thereof to a feeder head 7 supplied either with liquid nitrogen derived from a source 8 or with gaseous nitrogen supplied from a source 9. The feeder head 7 is connected with the source 8 or the source 9 by means of a three-position valve 10 schematically illustrated in FIG. 1. The annular space between the inner tube 5 and the outer tube 6 is connected to a source 11 of a cooling fluid by means of a conduit 12. The cooling fluid may for instance be a liquid fuel or a liquefied carbonic gas.

During the refining phase with oxygen, the stirring of the bath of molten material with nitrogen is not necessary, since the decarbonation process itself will provide a sufficient agitation of the bath of molten metal. During this refining phase, it is therefore merely necessary to blow a minimum amount of gas through the tuyeres, necessary to avoid plugging of the same. It is known that the general criterion used during this period consists in obtaining at the outlet end of the tuyere a sonic speed of the gas. Under these conditions, the minimum output necessary for the protection of the tuyere is in the neighborhood of 10 liters of nitrogen per second, and this output is obtained under a pressure of 2 bar.

At the end of the refining period with oxygen, there begins the treatment of the bath by mixing or stirring the bath with nitrogen. One substitutes therefore nitrogen in liquid form for the gaseous nitrogen previously blown in. Under a maximum pressure of 15 bar, the output of the nitrogen passing through each tuyere is about 0.2 liters per second, which upon contact with the molten metal in the converter vaporizes rapidly and furnishes an output of gas in the neighborhood of 120 liters per second, which corresponds to a desired value for an efficient stirring of the molten metal.

It is mentioned that, if one would continue to supply the tuyeres after the refining period with gaseous nitrogen, the maximum output which could be obtained for each tuyere would be only in the neighborhood of 60 liters per second.

Such an output would be insufficient for a satisfactory stirring of the bath of molten metal, and in this case it would be necessary either to double the number of tuyeres, or to utilize tuyeres with a greater internal diameter, which in either case would double the consumption of nitrogen necessary for the protection of the tuyeres.

It will therefore be evident that the process according to the present invention permits, during stirring of the molten bath with nitrogen, to double the stirring output at a given protection output, or differently expressed, to reduce the protection output to a half for a given stirring output.

It is to be understood that the above-mentioned relationship between the liquid nitrogen injected and the gaseous nitrogen developed therefrom upon contact with the molten metal is only valid for nitrogen, and this relationship must be modified if another liquefied gas is used. Thus, if a liquefied carbonic gas is used, the maximum mixing output obtainable per tuyere is in the neighborhood of 60 liters per second, that is, an output which is considerably unfavorable as compared with nitrogen. And the same holds true if liquefied argon is used in which the maximum output is in the neighborhood of 65 liters per second for each tuyere.

Figure 2:
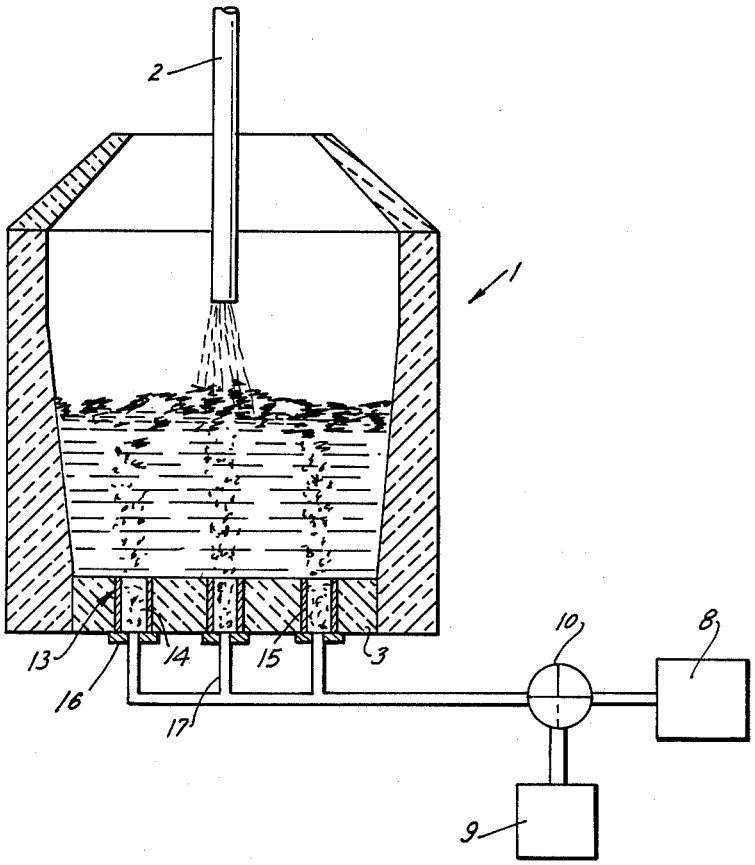
FIG. 2 illustrates a second embodiment according to the present invention, in which the injection device is constituted by a plurality of pieces of refractory material permeable to fluids.

Referring now to FIG. 2, there is again shown a converter 1 of the type LD and of a capacity of about 60 t. Five refractory pieces 13 permeable to fluids are placed in this case in the bottom 3 of the converter. Each of these pieces 13 are constituted by an assembly 14 of refractory plates laterally enclosed by a metallic envelope 15 closed at its outer end by a bottom 16. The pieces 13 are connected by conduits 17 to a feeder head 7, supplied either with liquid nitrogen from a source 8 or with gaseous nitrogen coming from a source 9. The feeder head 7 is connected either to the source 8 or to the source 9 by a three-position valve 10. The conduits 17 pass fluid-tightly connected through the closure plates 16 and communicate with the distribution channel for the injected fluid in the interior of the assembly with the refractory plates.

During the period of refining the bath of molten metal with oxygen, gaseous nitrogen is injected with an output inferior to one liter per second, and this output is obtained with a gas pressure of about 1 bar. At the end of the refining period, liquid nitrogen is injected through each of the refractory pieces 13 with an output in the neighborhood of 0.3 liters per second, which output is obtained with a pressure in the neighborhood of 6 bar. At the contact of the liquid nitrogen with the molten metal, the liquid nitrogen vaporizes rapidly and furnishes a gas output in the neighborhood of 200 liters per second.

According to a variation of the invention, the gaseous fluid and the liquid fluid may be of different chemical compositions. For instance, during refining of pig iron, the protective gas may be argon and the stirring liquid may be constituted by liquid nitrogen, the price of which is lower than that of liquid argon, and the injection of which after the refining period, that is when the bath of liquid metal is strongly oxidized, does not present a great risk of nitriding the bath. In addition, the injection of liquid nitrogen permits to obtain an output of vaporized gas which, as already pointed out above, cannot be obtained from injection of liquid argon.

The use of a fluid of the same composition still presents another appreciable practical advantage, that is the possibility of carrying out the invention with a single source of liquefied gas.

This single source is then connected to the means for injection by two parallel circuits, one of which comprises an evaporator and which are alternately activated by means of a bypass through which it is possible to furnish a protecting gas or a stirring liquid through the injection means into the bath of molten metal.

It is to be understood that the invention is not limited to a liquefied gas, but can be carried out with fluids which are in liquid state under normal conditions of temperature and pressure, whereby it is to be understood that only such fluids can be used which are not harmful to the metal which is to be stirred. It is further to be understood that a mixture of fluids of different chemical composition may also be used.

Considering the above, it is advantageous to use a stirring fluid which, per unit volume in liquid state, produces the maximum volume of gas by vaporization of contact with the liquid metal.

Expressed in a general way, it is of advantage to choose a stirring fluid which presents the greatest possible ratio of volumetric mass to molecular mass.

In this respect, liquefied gases appear best suitable. However, different fluids, such as water or organic liquids such as tetrachloride of carbon, may likewise be used.

Considering the above, one should not overlook other characteristics of the fluid to be injected, such as the viscosity of the mixing liquid on which depends the output which is possible to be passed through the injection device under a given pressure. This will explain that, under the operation conditions of the process according to the present invention, the utilization of liquid argon produces a stirring of the bath less strong than the utilization of liquid nitrogen. Nevertheless liquid nitrogen presents a ratio of volumetric mass to molecular mass inferior to the ratio of volumetric mass to molecular mass presented by liquid argon. In order to illustrate this fact, there is indicated that for liquid argon, said ratio is 35 $l^{-1}$, and that for liquid nitrogen, said ratio is 29 $l^{-1}$. Under normal conditions of temperature and pression, when one liter of liquid argon is injected, 800 liters of argon gas (supposed perfect gas) would be developed upon contact with the molten metal; and when one liter of liquid nitrogen is injected, 650 liters of nitrogen gas (supposed perfect gas) would be developed.

However, the viscosity of liquid argon is superior to the viscosity of liquid nitrogen. Consequently, under a pressure of 15 bars for example, only 0.09 liter/second of liquid argon may be introduced through the injection means which will be converted into 65 liters/second of stirring argon gas. On the contrary, under the same pressure of 15 bars, 0.2 liter/second of liquid nitrogen may be introduced through the same injection means which will be converted into 120 liters/second of stirring nitrogen gas. So the output of stirring gas obtained with nitrogen liquid is approximately twice the output of stirring gas obtained with liquid argon.

While the above considerations do not take into account the effect of cooling of the metal bath, especially due to vaporization of the stirring fluid, it is known to counterbalance this fact by different means such as preheating the fluid, if this is possible, or by prolongation of the blowing with oxygen beyond the period actually necessary for the refining. Furthermore, the process according to the present invention permits to reduce the stirring period as compared with known techniques. This is an appreciable advantage, especially with regard to the thermal program, since studies by the inventors have shown that the cooling of the steel bath in a converter during the stirring results actually less from the blowing of a stirring fluid into the bath than from the periods for taking samples and the duration of stirring, and these losses are reduced if the capacity of the converter increases.

Furthermore, it should be emphasized that if the stirring liquid could be under normal conditions of temperature and pressure, a gas which is liquefied prior to its injection, the opposite is possible with regard to the protective gas.

Indeed, according to a modification of the present invention, the protective gas can be under normal conditions of temperature and pressure a liquid which is vaporized prior to its passage through the injection device.

The particular advantages of this modification, as far as the thermal aspects of the operation are concerned, will be immediately understood.

Nevertheless, according to a further modification of the present invention, the protection of the injection device can be achieved by a gas obtained by the vaporization of a liquid and the stirring of the bath can be produced by the injection of a liquid derived from a liquefied gas, which permits to obtain the necessary output of gas for the stirring, while reducing to a certain extent the cooling of the bath during the periods the latter is not stirred.

It is further to be mentioned that the invention is not limited in its application to the stirring of a bath of molten metal in a converter, but the process according to the present invention can be used also for other purposes, such as the treatment of steel in a container, and more generally for any pneumatic stirring of a bath of molten metal by injection of a stirring fluid below the surface of the bath.

It will be understood that each of the elements described above, or two or more together, may also find a useful application in other types of processes for pneumatically stirring a bath of molten metal differing from the types described above.

While the invention has been illustrated and described as embodied in a method for periodically and pneumatically stirring a bath of molten metal by introducing an inert fluid through an injection device below the surface of the bath, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a metallurgical process in which a bath of molten metal has to be periodically stirred by introducing an inert gas through injection means below the surface of the bath, the steps of feeding, during a period in which no stirring of the bath by introducing an inert gas through injection means below the surface of the bath is carried out, a fluid in gaseous state through said injection means into the bath to prevent blocking of the injections means by the metal; and feeding, at the end of the period at which a fluid in gaseous is introduced through said injection means, a fluid in liquid state which will vaporize upon contact with the molten metal through said injection means into the bath to stirr the latter.

2. A process as defined in claim 1, wherein the fluid in gaseous state and the fluid injected in liquid state are of different chemical compositions.

3. A process as defined in claim 1, wherein the fluid injected in gaseous state and the fluid injected in liquid state are of the same chemical composition.

4. A process as defined in claim 1, wherein the fluid is nitrogen.

5. A process as defined in claim 1, wherein the fluid injected in liquid state is liquefied argon.

6. A process as defined in claim 1, wherein the fluid injected in liquid state is a liquefied carbonic gas.

7. A process as defined in claim 1, wherein the fluid injected in liquid state is under normal temperature and pressure a gas which has been liquefied prior to injection.

8. A process as defined in claim 1, wherein the fluid injected in gaseous state is under normal temperature and pressure a liquid which has been vaporized prior to injection.

9. A process as defined in claim 1, wherein the fluid injected in liquid state has the greatest possible ratio of volumetric mass to molecular mass.

10. A process as defined in claim 1, wherein the inert fluid is introduced into the bath of molten metal through injection means comprising a plurality of tuyeres communicating with the bath of molten metal below the surface of the bath.

11. A process as defined in claim 1, wherein the inert fluid is introduced below the surface of the bath by injection means comprising a plurality of pieces of refractory material having an oriented selective permeability and being inserted in the bottom of a vessel containing the bath of molten metal.

12. A process as defined in claim 1, wherein the process is used in a converter for the pneumatic conversion of pig iron into steel and including the step of blowing oxygen from above onto the bath of molten metal.

13. A process as defined in claim 1, wherein the process is used in a converter for the pneumatic conversion of pig iron into steel and including the step of blowing oxygen during a certain period from above into the bath of molten metal, and wherein during the period at which oxygen is blown into the bath of molten metal a fluid of gaseous state is fed through said injection means into the bath and at the end of the period in which oxygen is blown into the bath a fluid in liquid state which will vaporize quickly upon contact with the molten metal is fed through said injection means into the bath.

* * * * *